US005263702A

United States Patent [19]

Labua

[11] Patent Number: 5,263,702

[45] Date of Patent: Nov. 23, 1993

[54] PAPER SUPPLY CASSETTE INSERT FOR COPYING MACHINES

[76] Inventor: David W. Labua, 5663 Florence Ter., Oakland, Calif. 94611

[21] Appl. No.: 807,042

[22] Filed: Dec. 12, 1991

[51] Int. Cl.[5] ..... B65H 1/00

[52] U.S. Cl. ..... 271/171

[58] Field of Search ..... 271/9, 145, 161, 164, 271/171

[56] References Cited

U.S. PATENT DOCUMENTS

| | | | |
|---|---|---|---|
| 3,642,273 | 2/1972 | Baglio . | |
| 4,005,794 | 2/1977 | Lundquist | 271/171 |
| 4,131,274 | 12/1978 | Sue | 271/9 |
| 4,303,235 | 12/1981 | Calabrese | 271/9 |
| 4,343,461 | 8/1982 | Tomimori et al. | 271/171 |
| 4,509,738 | 4/1985 | Aoki | 271/171 |
| 4,538,799 | 9/1985 | Bhagwat | 271/9 |
| 4,569,587 | 2/1986 | Miyoshi et al. | 355/127 |
| 4,607,834 | 8/1986 | Dastin | 271/171 |
| 4,786,042 | 11/1988 | Stemmle | 271/9 |
| 4,838,535 | 6/1989 | Yokoi et al. | 271/171 |
| 4,874,160 | 10/1989 | Yamamoto | 271/171 |
| 5,085,419 | 2/1992 | Bell | 271/71 |

FOREIGN PATENT DOCUMENTS

| | | | |
|---|---|---|---|
| 978558 | 8/1972 | Canada | 271/171 |
| 9646 | 1/1982 | Japan | 271/9 |
| 227638 | 12/1984 | Japan | 271/171 |

OTHER PUBLICATIONS

Brown, L. C., et al. "Dual Paper Cassettes with Common Feed Mechanism", *IBM Technical Disc. Bull.* vol. 23, No. 7A, pp. 2683-2685. Dec. 1980.

*Primary Examiner*—Robert P. Olszewski
*Assistant Examiner*—Steven M. Reiss
*Attorney, Agent, or Firm*—Schapp and Hatch

[57] ABSTRACT

Paper supply cassette inserts for copy machines are disclosed which adapt cassettes for such machines for feeding sub-standard paper sizes. These inserts carry the sub-standard paper to be fed and are completely inserted in the paper cavity of existing paper supply cassettes without modification of those paper supply cassettes. Each insert includes a paper stack carrying platform, one or more paper stack locating stops, and positioning means for positioning the paper stack within the cavity of the cassette.

2 Claims, 2 Drawing Sheets

PAPER SUPPLY CASSETTE INSERT FOR COPYING MACHINES

BACKGROUND OF THE INVENTION

1. Field of the Invention

My present invention relates to copying machines, and more particularly to the paper supply cassettes of copying machines.

2. Description of the Prior Art

Paper supply cassettes or trays adaptable to accommodate stacks of sheet material of different widths and lengths are known in the prior art.

For example, a paper tray for copying machines adapted to support a stack of sheet material thereon which tray is adjusted by a stepping motor to accommodate stacks of sheet material of different widths and lengths is shown and described in U.S. Pat. No. 4,607,834, issued to Richard M. Dastin on Aug. 26, 1986.

Also, a paper feeding cassette for receiving paper piles of different widths is shown and described in U.S. Pat. No. 4,343,461, issued to Kayoshi Tomimori and Shunichi Nakajima on Aug. 10, 1982.

Yet further, a paper tray assembly for paper reproduction systems comprising an adjustable paper guide adaptable to different sizes of paper is shown and described in U.S. Pat. No. 4,005,794, issued to Robert H. Lundquist on Feb. 1, 1977.

It is also known to provide a paper carton with an inner compartment for use in feeding small-sized paper. In particular, U.S. Pat. No. 3,642,273, issued to James P. Baglio on Feb. 15, 1972, shows and describes a carton having an inner compartment for containing a quantity of paper smaller in size as compared to the overall size of the carton and usable for insertion in the paper receptacle of a copying machine whereby the machine's feed rollers may successfully propel the small-sized paper through the machine.

The paper supply tray of Dastin has the disadvantage that it is complex and expensive, in that the adjustment thereof to sheet size "it achieved by coupling the rear guide and side guides of the tray to a cam having cam tracks on opposed surfaces thereof", which "cam is rotated by a stepper motor with the angular rotation of the cam controlling the location of the side guides and rear guide with respect to the base plate".

The paper feeding cassette of Tomimori and Nakajima is characterized by mechanical complexity, and thus by high cost, and is further characterized by the fact that its paper guides must be manually positioned and manually secured in the desired position by screws.

The paper tray assembly of Lundquist is characterized by the disadvantage that it must either be completely unloaded, and its paper guides repositioned and secured by screws, or a separate tray must be provided for each desired paper size. Lundquist suggests at column 3 "that various trays adjusted to hold various sizes of papers and/or colors of papers may be stored in a rack" adjacent the copy machine.

The specialized paper carton of Baglio not only has the disadvantage that the paper to be used in the copy machine must be purchased in the patented carton of Baglio, but is also characterized by the further disadvantage that this carton cannot be used in the many paper cassettes which comprise a hinged vertical feed plate.

Summarizing, it can be seen that the devices of these prior art United States patents are characterized by several disadvantages, such as the necessity for manual adjustment, complexity and expense, and/or limited utility.

It is believed that the documents listed immediate below contain information which is or might be considered to be material to the examination hereof.

U.S. Pat. No. 4,509,738
U.S. Pat. No. 4,569,587
U.S. Pat. No. 4,786,042
U.S. Pat. No. 4,874,160

No representation or admission is made that any of the above-listed or discussed documents is part of the prior art, or that a search has been made, or that no more pertinent information exists.

The term "prior art" as used herein or in any statement made by or on behalf of applicant means only that any document or thing referred to as prior art bears, directly or inferentially, a date which is earlier than the effective filing date hereof.

A copy of each of the above-listed and discussed patents is supplied to the U.S. Patent and Trademark Office herewith.

SUMMARY OF THE INVENTION

Accordingly, it is an object of my present invention to provide paper supply cassette inserts for copying machines, the use of which cassette inserts requires no manual adjustment for paper size.

Another object of my present invention is to provide paper supply cassette inserts whereby paper size in a copying machine can be rapidly and easily changed without the expense of providing a separate cassette for every desired paper size.

Yet another object of my present invention is to provide paper supply cassette inserts for the paper supply cassettes of existing copying machines, which paper supply cassette inserts are adapted for use in a wide variety of existing paper cassettes, including paper cassettes which comprise hinged paper stack raising plates.

A further object of my present invention is to provide paper supply cassette inserts which are so constructed and arranged in accordance with my invention that two inserts, one for longitudinal feed cassettes and the other for transverse feed cassettes, are adapted to fully and correctly cooperate with a very wide variety of existing standard copying machine cassettes, without modification of any of those copying machine cassettes, and without making any manual adjustments.

Other objects of my present invention will in part be obvious and will in part appear hereinafter.

My present invention, accordingly, comprises the several steps and the relation of one or more of such steps to each of the others, and the apparatus embodying features of construction, combinations of elements, and arrangements of parts which are adapted to effect such steps, all as exemplified in the following disclosure, and the scope of my present invention will be indicated in the claims appended hereto.

In accordance with a principal feature of my present invention a paper cassette insert for the paper supply cassettes of a variety of copying machines is provided, which paper cassette insert is adapted to accommodate but one size of paper and thus requires no manual adjustment for paper size.

In accordance with another principal feature of my present invention the paper supply cassette insert thereof serves as a storage receptacle for a stack of paper when said paper cassette insert is not inserted in the paper cassette of a copying machine.

In accordance with yet another principal feature of my present invention the paper cassette insert of my invention is so constructed and arranged as to be easily and securely manually grasped, with one digit of the grasping hand frictionally retaining a stack of paper therein.

In accordance with a further principal feature of my present invention certain paper cassette inserts of my invention are provided with hinged paper supporting panels adapted to coact with the hinged paper stack raising elements of certain existing copying machine paper cassettes.

In accordance with a yet further principal feature of my present invention two paper cassettes thereof, one designed to coact with transverse feed paper cassettes and the other designed to coact with longitudinal feed paper cassettes are between them adapted to coact with the paper cassettes of a wide variety of existing copying machines.

For a fuller understanding of the nature and objects of my present invention, reference should be had to the following detailed description, taken in connection with the accompanying drawings.

DESCRIPTION OF THE PREFERRED EMBODIMENTS

Figure 1:
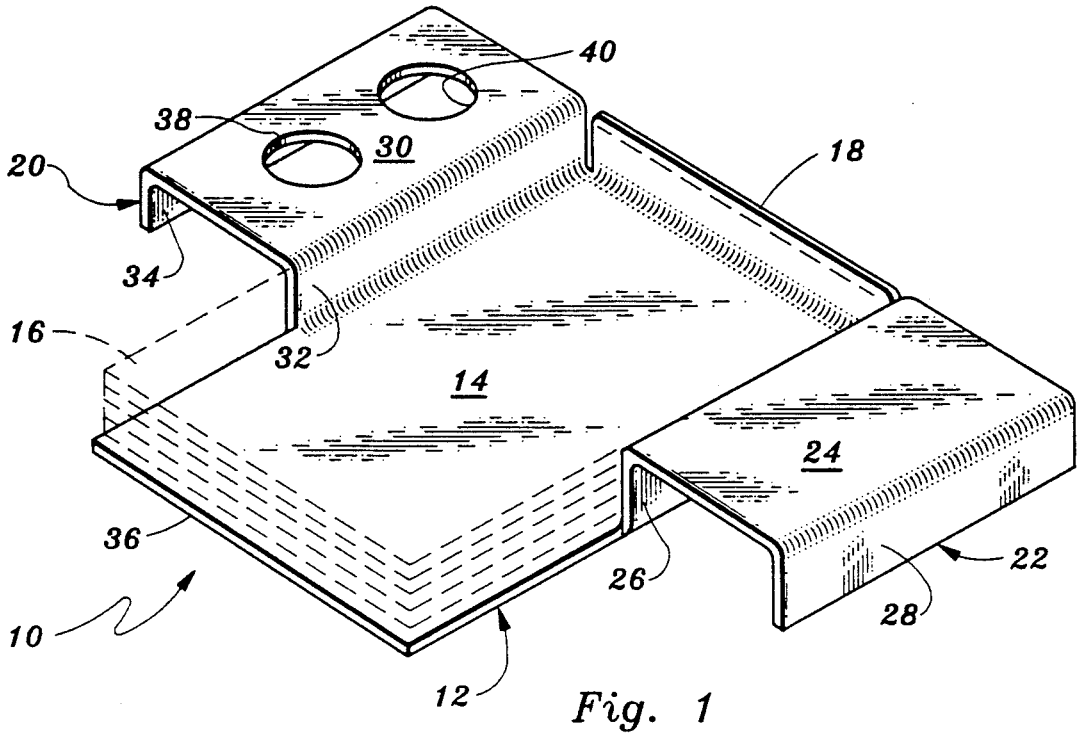
FIG. 1 is a perspective view of a paper supply cassette insert constructed in accordance with the first preferred embodiment of my present invention.

Referring now to FIG. 1, there is shown paper supply cassette insert 10 of the first preferred embodiment of my invention.

Insert 10 is preferably fabricated from a single piece 12 of rigid plastic material such as the plastic material known under the trade name KOMATEX, the thickness of which is approximately ⅛th inch.

The central portion of insert 10 is a rigid, flat platform member 14 the width of which is approximately 5½ inches and the length of which is approximately 8½ inches.

Thus, as seen in FIG. 1, platform 14 is adapted to bear a stack 16 of half letter size or 5½ inch by 8½ inch paper sheets.

As also seen in FIG. 1, a lip 18 is upturned at the rear edge of platform 14.

As further seen in FIG. 1, a pair of ears 20, 22 are integral, respectively, with the opposite edges of platform 14.

Ear 22 is comprised of a flat, rigid top member 24, a flat, rigid vertical inner side member 26, and a flat, rigid vertical outer side member 28.

Similarly, ear 20 is comprised of a top member 30, an inner side member 32, and an outer side member 34.

In the first preferred embodiment of my invention the inner side members 26, 32 extend to approximately the same height above platform 14 as the height or vertical dimension of lip 18, whereby inner side members 26, 32 and lip 18 together provide a receptacle or pocket for receiving stack 16.

As will now be evident to those having ordinary skill in the art, informed by the present disclosure, insert 10 is comprised of planar members 14, 18, 24, 26, 28, 30, 32, 34, all of which are substantially rigid and are integrally joined together along their common edges, with the exception of the common edges between lip 18 and inner side members 26, 32, which may or may not be joined together as a matter of design choice.

In the first preferred embodiment of my invention the overall side-to-side dimension of insert 10, from the outer face of outer side member 34 to the outer face of outer side member 28, is approximately 10.9 inches; and the overall front-to-back dimension of insert 10, from the front or leading edge 36 of platform 14 to the rear surface of lip 18, is approximately 8.5 inches. Also in the first preferred embodiment, the height of ear 22, i.e., the distance between the plane containing the lower surface of platform 14 and the plane containing the upper surface of top members 24, 30, is approximately 1.2 inches.

The front-to-rear dimension of wings 20, 22 in the first preferred embodiment is approximately 5.0 inches, although it is to be understood that this is not a critical dimension.

As further seen in FIG. 1, a pair of finger holes 38, 40 are provided in top member 30 of ear 20. These finger holes constitute a feature of my invention, and provide means whereby insert 10 and stack 16 can be conveniently lifted from a place of storage, with stack 16 frictionally secured in place, and dropped into a copying machine paper cassette as hereinafter described.

In the use of finger holes 38, 40 in accordance with the method of my invention, insert 10 containing stack 16 being disposed upon a convenient table or shelf, the middle finger and index finger of one hand are engaged in finger holes 38, 40, respectively, and stack 16 pressed against platform 14 with the thumb of the same hand. Insert 10, containing stack 16, then can be conveniently lifted from the shelf or table and deposited in a copy machine paper cassette as hereinafter described in connection with FIG. 2.

This method of lifting insert 10 and stack 16 has the distinct advantage that finger holes 38, 40 are cheap and easy to provide, and finger holes 38, 40 do not project outwardly from insert 10, as would a directly graspable handle.

Figure 2:
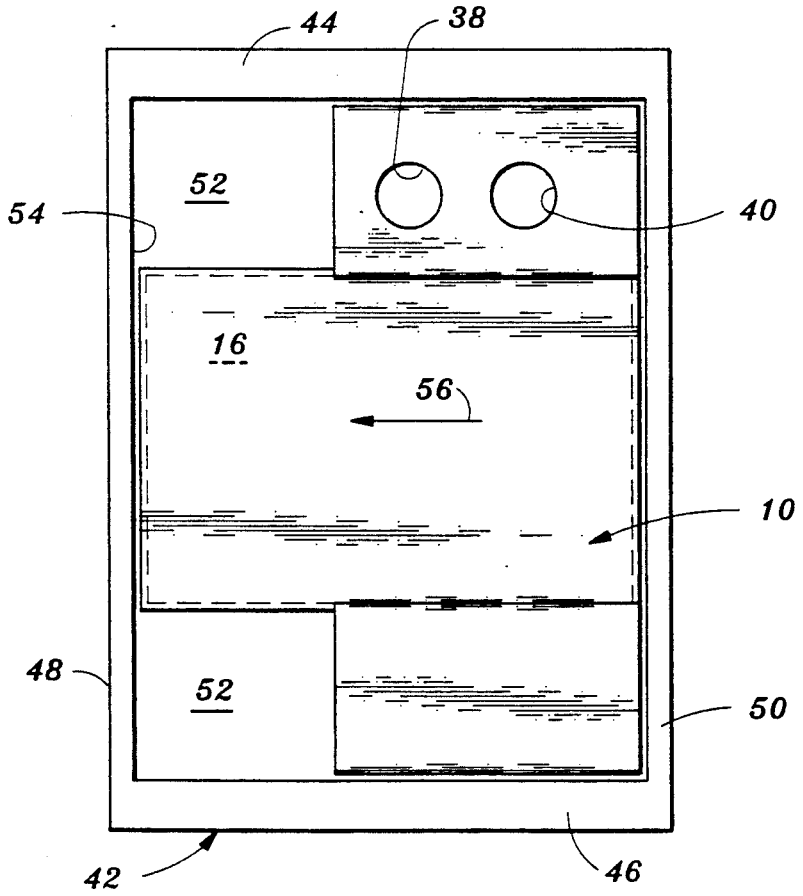
FIG. 2 is a plan view of a paper supply cassette in which is disposed the paper supply cassette insert of the first preferred embodiment of my present invention shown in FIG. 1.

Referring now to FIG. 2, there is shown a letter size paper cassette from a ROYFAX Plain Bond Copier, Model 115, sometime made and sold by the Royal Business Machines Division of Litten Industries, Inc., the cover of which is deleted for clarity of illustration. In conventional use the paper cavity of said paper cassette is filled with letter size sheets of paper and is covered by the abovesaid cover. This cassette is then manually thrust into a receptacle located in one end of the copier, and automatically locked therein, whereafter a single sheet of letter size paper is fed into the paper path of the copier each time a copy is to be made.

This particular copier, along with many other existing copiers, is provided with cassettes for feeding either legal size paper sheets or letter size paper sheets.

There currently exist many thousands of copiers, used in corporate offices, government agencies, schools and universities and major law and accounting offices, which are adapted to process letter size sheets and nothing smaller.

In many such institutions, however, these copiers are frequently used to reproduce memoranda the total area of which is, or can easily be made, less than 5½×8½ inches.

The all too common practice of reproducing these short memoranda on letter size sheets, because half-letter size (5½ inch ×8½ inch) paper cassettes are either not available or quite expensive, results in a great waste of paper, and a corresponding great waste of pulp wood, upon the supply of which the industrial world is already seriously pressing.

The principal object of my invention, then, is to provide simple, inexpensive inserts for the paper cassettes of copying machines whereby existing copying machines can be instantly adapted to the handling of half-letter size sheets, without modification of the copy machine or any of its paper cassettes, and without purchasing new paper cassettes to be dedicated to half-letter size sheet processing, which new paper cassettes may be either expensive to purchase or not available.

Referring again to FIG. 2 it will be seen that in the use of insert 10 of my invention the insert, in which is disposed a stack of half-letter size sheets 16, is simply dropped into well paper 54 of paper cassette 42 in place of the usual stack of letter size sheets.

Depositing insert 10 in paper cassette 42 can be easily done by inserting the index and middle fingers of the right hand into openings 38, 40, pressing the thumb of the right hand against the top of stack 16 and thus raising insert 10 from a table or shelf upon which it is disposed, registering it with well 54, and moving it downward into well 54. It is within the scope of my invention to provide two additional openings in the opposite wing of insert 10 for the convenience of left-handed persons.

It is to be noted that insert 10 not only serves the purpose hereinabove described, but also serves as a convenient receptacle in which to store a stack 16 of half-letter size sheets when the associated copier is being used to process sheets of other sizes.

As well known to those acquainted with the Model 115 ROYFAX plain bond copier and other similar existing copiers, and as indicated by arrow 56 in FIG. 2, paper cassette 42 is of the type sometimes called a transverse feed paper cassette, for the reason that the direction in which paper sheets are fed from paper cassette 42 is transverse to the longitudinal axis or longer dimension of paper cassette 42.

It is to be understood that insert 10 is not limited to use in connection with the letter size paper cassette of the ROYFAX Model 115 plain bond copier. To the contrary, it will be found that paper cassette 10 can be used in the letter size, transverse feed paper cassettes of many other widely sold copying machines.

It has been the objective of the development of my invention to provide a paper cassette insert for half-letter size sheets which can be used in the greatest possible number of different types and styles of letter size, transverse feed paper supply cassettes, so that the wasteful practice of using letter size sheets when only half-letter size sheets are needed can be immediately discontinued in as many different copying machines as possible without modifying those machines and without purchasing costly additional cassettes.

As is well known to those having ordinary skill in the copying machine art, however, many existing copiers are provided only with longitudinal feed cassettes, i.e., cassettes from which the paper sheets contained therein are fed in the longitudinal direction, i.e., in the direction parallel to the longitudinal axis or major dimension of the cassette.

It is therefore an object of my invention to provide paper cassette inserts for adapting the longitudinal feed cassettes of many existing copying machines to the feeding of half-letter size sheets, without modification of the cassette.

Figure 3:
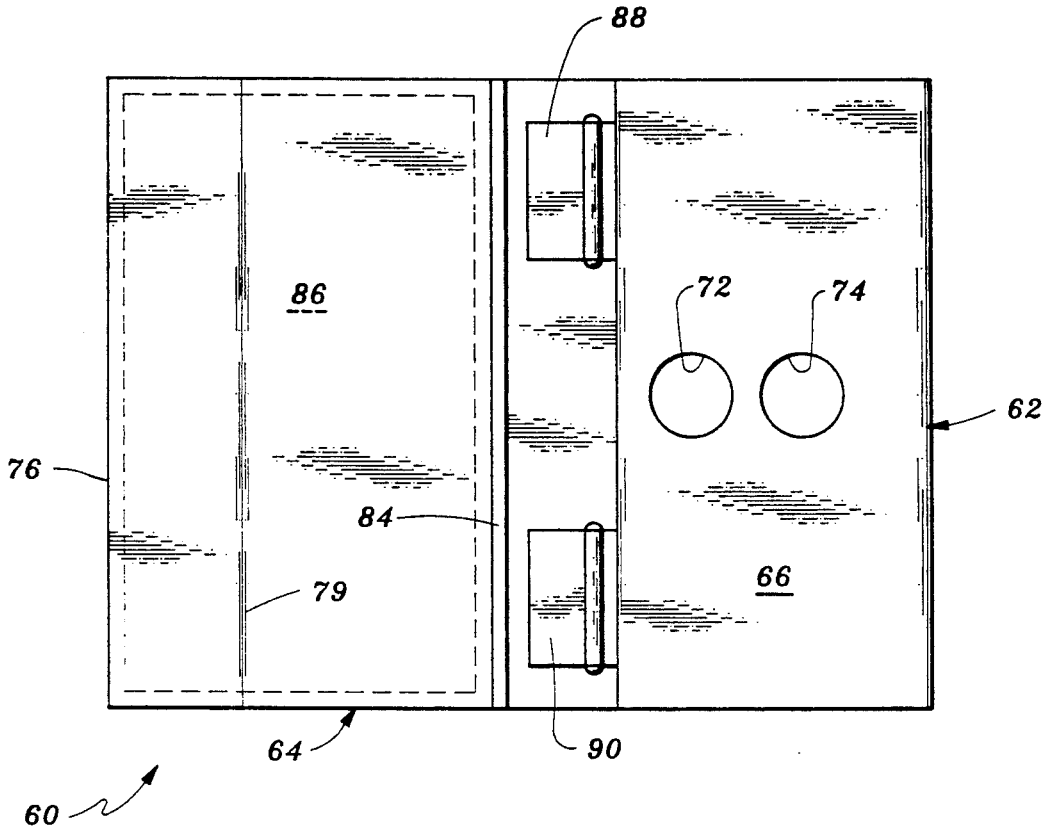
FIG. 3 is a plan view of a paper supply cassette insert constructed in accordance with the second preferred embodiment of my present invention.
Figure 4:
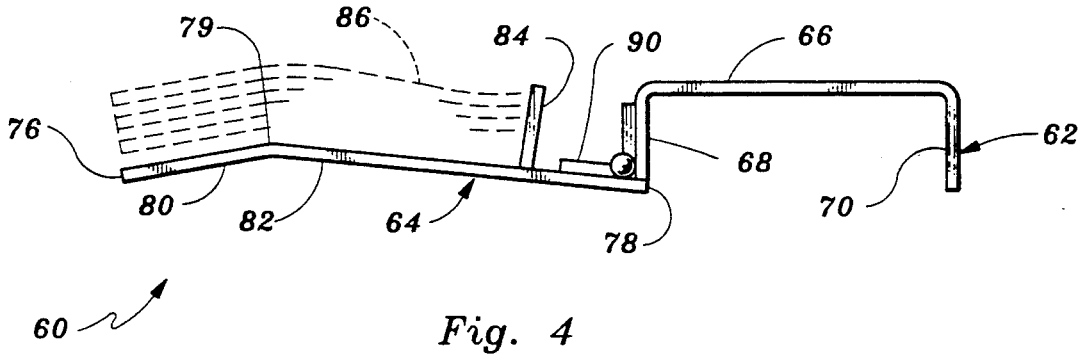
FIG. 4 is an elevational view of the paper supply cassette insert of the second preferred embodiment of my invention shown in FIG. 3.

Referring now to FIGS. 3 and 4, there is shown a paper cassette 60 of the second preferred embodiment of my invention, which paper cassette 60 is adapted for use in the longitudinal feed paper cassettes of a wide variety of copying machines for the feeding therefrom of half-letter size sheets without modification of the cassette and without purchasing new cassettes, which many not be available.

As seen in FIGS. 3 and 4, paper cassette insert 60 is comprised of two major portions, viz., body 62 and tongue or platform 64.

Body 62 is a single piece of rigid plastic material, such as KOMATEX, and includes a horizontal planar major member 66 and two vertical wall members 68, 70 which are integrally joined to major planar member 66 along their common edges.

The major dimension or length of planar member 66 is slightly less than 8.5 inches, and its width, from the outside edge of wall 68 to the outside edge of wall 70, is approximately 4.5 inches.

As best seen in FIG. 3, planar member 66 is provided with a pair of grasping holes or openings 72, 74 which serve substantially the same function as that of grasping holes or openings 38, 40 of the first preferred embodiment of my invention.

The height or minor dimension of wall member 70 is approximately 1.5 inches, and the height or minor dimension of wall member 68 is approximately 1.35 inches.

As best seen in FIG. 3, the width or major dimension of tongue 64 is substantially equal to the length of body 62, i.e., slightly less than 8.5 inches.

The length of tongue 64, from its outer end 76 to its inner end 78, is approximately 6.8 inches.

Tongue 64 is preferably fabricated from the same plastic material as body 62, e.g., ⅛ inch thick KOMATEX, and is also substantially rigid.

As best seen in FIG. 4, tongue 64 is provided with a bend 79 which subdivides tongue 64 into two planar portions or segments 80, 82.

As further seen in FIG. 4, a rigid, vertical stop 84 is adhered to the upper surface of segment 82 of tongue 64, as by cementing.

As best seen in FIG. 4, stop 84 is provided to maintain in alignment the inner edges of the paper sheets of stack 86, which in the utilization of insert 60 is borne by tongue 64.

As may be seen by comparison of FIGS. 3 and 4, tongue 64 is hingedly affixed to body 62 by means of a pair of hinges 88, 90.

The leaves of hinges 88, 90 are affixed, respectively to body 62 and platform 64 by cementing.

It is to be particularly noted (FIG. 4) that the lower edge of wall member 68 bears upon the upper surface of tongue 64 when tongue 64 is in the position shown in FIG. 4. Thus, platform 64 can be tilted upward from its position shown in FIG. 4, but cannot be tilted downward therefrom.

As is well known to those having ordinary skill in the copying machine art, the paper cassettes of many copying machines are provided with stack raising tongues which raise the paper stack or at least the forward end thereof into contact with the paper feed wheels which are built into the copying machine immediately above the paper cassette receiving receptacle.

Thus, it will be seen that tongue 64 is hinged by hinges 88, 90 so that it can rise in response to the rising of the paper stack raising tongue of the paper cassette into which it is inserted, whereby the raising of the entire insert 60 and the consequent jamming of the copy machine mechanism is avoided.

In the utilization of insert 60 in accordance with the principles of my invention a stack 86 of paper sheets is placed on tongue 64 in the manner shown in FIGS. 3 and 4, insert 60 and stack 86 are grasped by the user's hand, with index and middle fingers engaged in grasping holes 62, 64 and the thumb of the same hand clamping stack 86 on tongue 64, insert 60 and stack 86 are then placed in the well of the associated paper cassette with tongue 64 nearest the inner end of the paper cassette receptacle of the copy machine, and the copy machine is operated in the known manner.

It will thus be seen that the objects set forth above, among those made apparent from the preceding description, are efficiently attained, and since certain changes may be made in the above constructions and the method carried out thereby without departing from the scope of my present invention, it is intended that all matter contained in the above description or shown in the accompanying drawings shall be interpreted as illustrative only, and not in a limiting sense.

It is to be understood, however, that certain variations of the first and second preferred embodiments shown and described herein will occur to those having ordinary skill in the art without the exercise of invention or undo experimentation, and thus it is to be understood that all such variations fall within the scope of my invention.

For instance, it will occur to those having ordinary skill in the art that the discrete pin hinges 88, 90 may be replaced with a single strap hinge, or a plurality of strap hinges.

It is also be to understood that in certain embodiments of my invention pin hinges or strap hinges may be replaced by a "live" hinge, in which case an alternative stopping means will be provided to prevent the tongue or platform from pivoting beyond the position shown in FIG. 4.

It will also occur to those having ordinary skill in the art to provide additional openings in the tongues or platforms of certain embodiments of my invention to accommodate stack presence sensors, whether those stack presence sensors are mechanical or photoelectric.

It may also be found desirable to face all or part of the tongue or paper carrying platform of any embodiment of my invention with suitable anti-skid material.

It will also occur to those having ordinary skill in the art that the principles of my invention may be applied to the handling of sub-sized paper sheets other than half-letter size sheets, and such alterative embodiments are to be understood to fall within the scope of my invention.

It is also to be understood that the following claims are intended to cover all of the generic and specific features of my invention hereindescribed, and all statements of the scope of my invention which, as a matter of language, might be said to fall therebetween.

What is claimed is:

1. A paper supply cassette insert for carrying a stack of sub-standard size copy paper and positioning the same within the paper well of an existing, unmodified paper supply cassette for the proper feeding of paper from said stack without modification of said cassette, comprising:

a platform for carrying said paper stack having an upstanding paper stop on only one edge; and positioning means for positioning said insert within said well of said paper supply cassette;

said entire insert and said paper stack being receivable within said paper well of said paper supply cassette so that said paper supply cassette can be inserted into the cassette receptacle of an associated copy machine;

said existing paper supply cassette being devoid of insert receiving means which serve solely for receiving said insert;

said platform being hingedly connected to said positioning means.

2. A paper supply cassette insert as claimed in claim 1 in which said positioning means is provided with a pair of adjacent finger-receiving holes so positioned that said insert may be grasped with the index and middle fingers of one hand and the paper stack retained on said platform by the thumb of the same hand while said insert is being inserted into said paper supply cassette.

* * * * *